United States Patent [19]

Scott et al.

[11] Patent Number: 4,928,572

[45] Date of Patent: May 29, 1990

[54] PULSED AC ELECTROMAGNETIC PROJECTILE LAUNCHER APPARATUS

[75] Inventors: Dennis J. Scott, Jeannette; Raymond M. Calfo, Murrysville, both of Pa.

[73] Assignee: Westinghouse Electric Corp., Pittsburgh, Pa.

[21] Appl. No.: 339,339

[22] Filed: Apr. 17, 1989

[51] Int. Cl.[5] ..... F41F 1/02

[52] U.S. Cl. ..... 89/8; 124/3; 318/135

[58] Field of Search ..... 89/8; 124/3; 318/135

[56] References Cited

U.S. PATENT DOCUMENTS 4,369,691 1/1983 Baehr et al. ..... 89/8

4,836,083 6/1989 Triezenberg ..... 89/8

*Primary Examiner*—Stephen C. Bentley

*Attorney, Agent, or Firm*—D. Schron

[57] ABSTRACT

An electromagnetic projectile launcher which uses a pulsed AC generator with a power supply. The generator is operative to supply a relatively low current pulse to initially accelerate the armature after which an extremely high current pulse is applied for main acceleration. The pre-acceleration pulse may be derived from an auxiliary winding on the generator or may be provided by a relatively smaller generator operated in synchronism with the main generator or physically coupled thereto.

5 Claims, 6 Drawing Sheets

PULSED AC ELECTROMAGNETIC PROJECTILE LAUNCHER APPARATUS

BACKGROUND OF THE INVENTION

1. Field of the Invention

The invention in general relates to electromagnetic projectile launchers, and in particular to a launcher which uses an AC generator for the power supply.

2. Background Information

One type of electromagnetic launcher, known as a railgun, basically consists of a power supply and two generally parallel electrically conducting rails between which is positioned an electrically conducting armature. Current from the power supply is commutated into the rail system and flows down one rail, through the armature and back along the other rail whereby a force is exerted on the armature to accelerate it, and a payload, so as to attain a desired muzzle or exit velocity.

The power supply delivers a DC pulse which may be measured in hundreds of thousands or even millions of amps. The sudden application or a current pulse of this magnitude when applied to the rails and stationary armature may possibly cause damage to the armature and/or rail system. For this purpose therefore it is desirable to pre-accelerate the armature prior to the application of the main current pulse to the rails. Various types of power supplies may be used and in the present invention is directed to an arrangement which uses a pulse AC generator. As will be brought out, preacceleration of the armature by the current pulse supplied presently results in a reduced performance launcher.

The present invention obviates the objections to currently known pulsed AC generator launcher systems and provides a system which is much more efficient, enabling higher muzzle velocities.

SUMMARY OF THE INVENTION

The apparatus described herein includes a pair of generally parallel conductive launcher rails having a breech end and a muzzle end. A high current connection is provided at a location intermediate the ends and between this connection and the breech end, the rails include a high resistance portion. An armature is provided for propelling a projectile and is initially placed at the breech end of the rail system. The power supply includes a pulsed AC generator means having first output terminals for providing a relatively high current pulse to the high current connection, and second output terminals for providing a relatively lower current pulse to the breech end of the rails. The second output terminals are connected to the breech end by a connection which includes switch means which is operable, in conjunction with the pulsed AC generator, such that the lower current pulse is delivered to the breech end prior to the application of the higher current pulse to the high current connection. This operation results in a preliminary initial acceleration of the armature past the higher resistance portion of the rails whereupon the high current pulse is delivered to accelerate the armature to its desired exit velocity.

DESCRIPTION OF THE PREFERRED EMBODIMENTS

Figure 1:
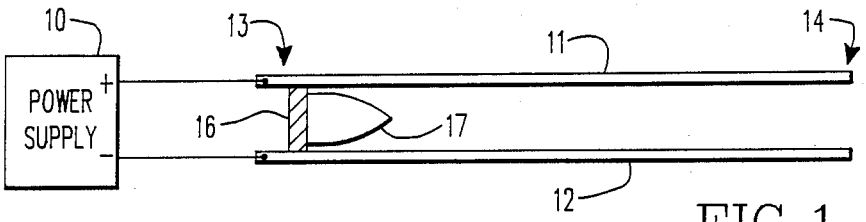
FIG. 1 PRIOR ART
FIG. 1 illustrates the basics of a typical electromagnetic launcher.

Referring now to FIG. 1, there is illustrated a typical electromagnetic launcher system which includes a power supply 10 for supplying a high DC current to generally parallel electromagnetic launcher rails 11 and 12, the rails having a breech end 13 and a muzzle end 14.

An electrically conducting armature 16 bridges the rails and is free to move therealong to accelerate a projectile 17. In operation, when a high DC current is supplied to the breech end 13 of the rails 11 and 12 current flows down one rail, through the armature 16 and back along the other rail such that the current flowing in the loop exerts a force on the armature to accelerate it. The accelerating force basically is a function of the magnetic flux density and current density and since the current flowing in the rails may be hundreds of thousands or millions of amps, projectile 17 exits the muzzle end of the rail system at exceptionally high velocities measurable in many kilometers per second.

Figure 2:
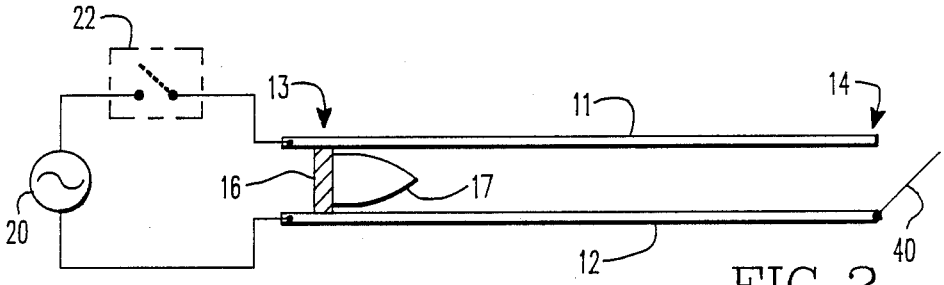
FIG. 2 PRIOR ART
FIG. 2 illustrates a typical electromagnetic launcher using a pulsed AC generator power supply.

FIG. 2 illustrates a well known variety of electromagnetic launcher in which the power supply takes the form of a pulsed AC generator 20. Generator 20 is connected to the breech end 13 of rails 11 and 12 by switching means 22 operable to close at a precise instant during the operation of generator 20 and then instantly open so as to deliver a unidirectional pulse to the rail system.

Very basically, the sudden short circuiting of a synchronous generator such as the pulsed AC generator 20 will produce a transient current many times larger than its steady state current rating. Properly timed, this transient current will contain a DC component equal to the peak value of the alternating component resulting in a current trace with the first cycle fully offset from the zero current line.

Figure 3:
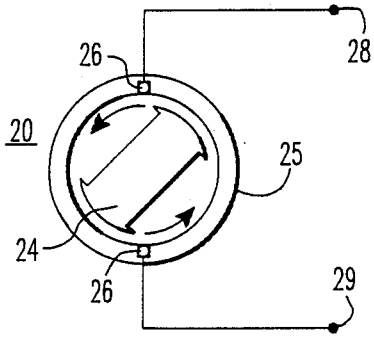
FIG. 3 is a representation illustrating the rotor and stator of the generator of FIG. 2.

With additional reference to FIGS. 3 and 4A through 4C, the generator 20 in FIG. 3 is represented by rotor 24 surrounded by stator 25 having a stator winding 26. Generator output terminals 28, 29 are electrically connected to the stator winding 26.

Figure 4A:
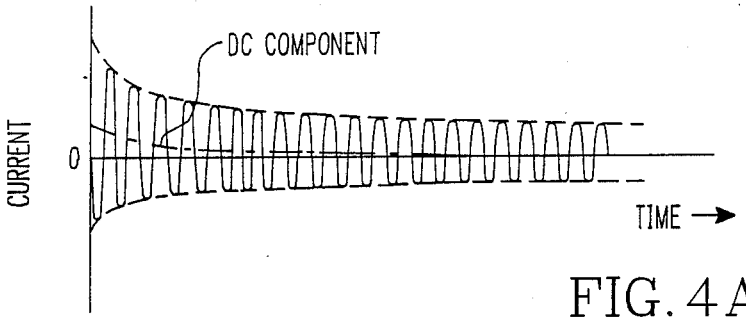
FIGS. 4A through 4C are waveforms illustrating one operation of a pulsed AC generator.
Figure 4B:
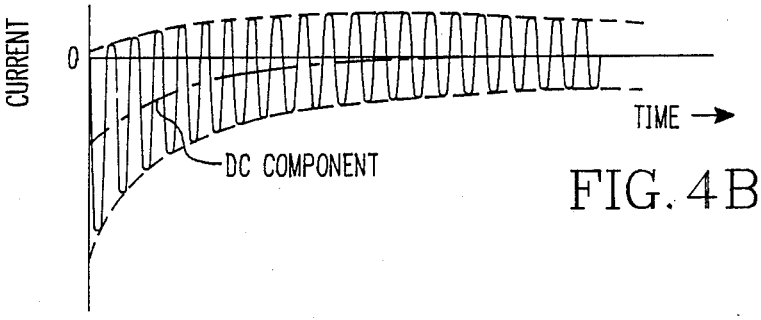
Figure 4C:
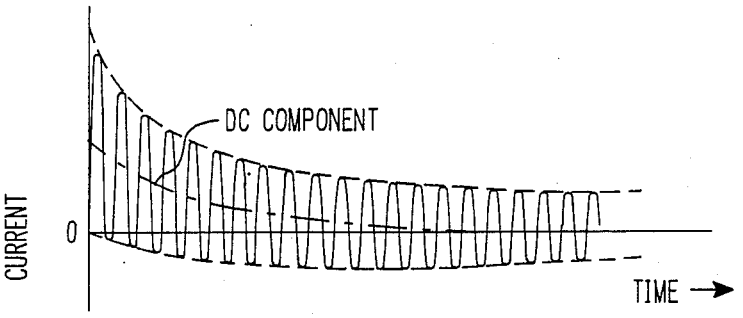

FIGS. 4A through 4C illustrate curves of transient currents produced by the sudden short circuiting of terminals 28, 29 when operating at full open circuit voltage. Depending upon the angular orientation of rotor 24 when the output terminals are shorted, different transients are produced having different DC components as indicated in the curves of 4A through 4C. With the closing of switch means 22 at the appropriate time, and as illustrated in FIG. 4C, the first cycle 30 of transient current is fully offset and constitutes a pulse of DC which is supplied to the rail system to drive the armature 16. The magnitude of the pulse is a function of the generator voltage just prior to the short circuit and the internal impedance of the generator. The width of the pulse is a function of the frequency of the alternating voltage which is established by the speed of rotation and number of poles of the rotor.

In order to reduce the length required for rails 11 and 12, the system may include a shorting or closing switch at the muzzle end of the rails and operable to close as the projectile exits the rail system whereupon all of the inductive energy stored in the magnetic field of the rail system will go back into the generator 20 to cause increased acceleration of the rotor thereof.

Figure 5:
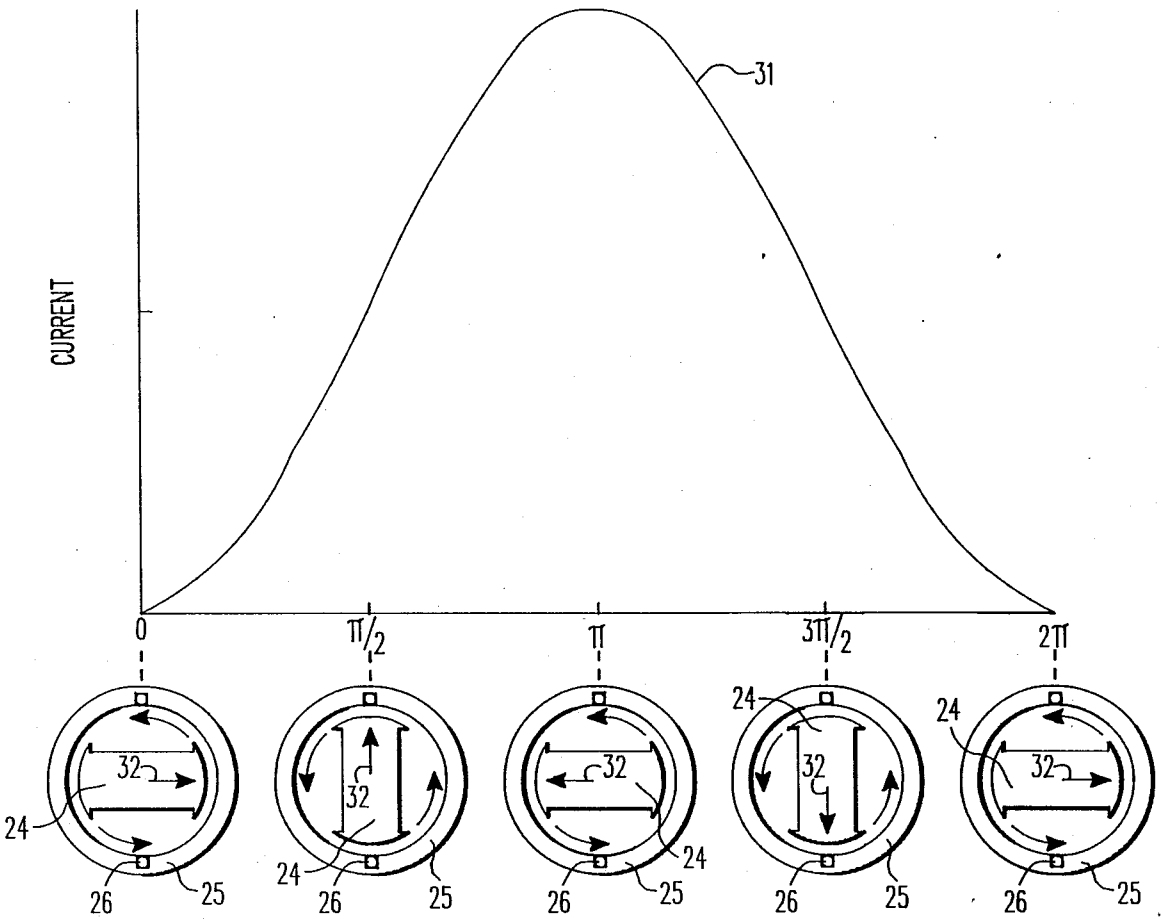
FIG. 5 illustrates the relationship of rotor to stator in the production of a pulse.
Figure 6:
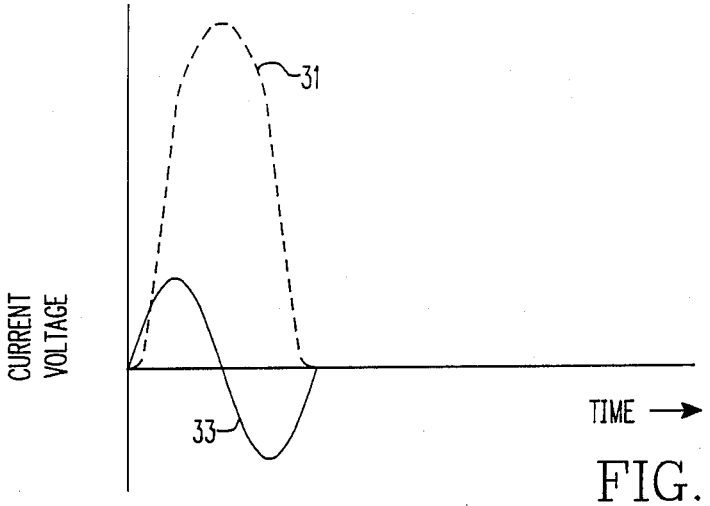
FIG. 6 illustrates a provided pulse in relation to a generator waveform.

FIG. 5 serves to illustrate the angular orientation of the rotor 24 with respect to the stator 25 during the production of a DC pulse 31 after short circuiting of the generator output terminals. In FIG. 5 the angular orientation of the rotor 24 is illustrated at 5 positions, 0, $2^{\pi}$, $2^{3\pi}$, and $2\pi$. In each case, rotation is counterclockwise and an arrow 32 is superimposed upon the rotor 24 for reference purposes. In FIG. 6 there is illustrated, in idealized form, the pulse 31 superimposed upon the first full cycle of generator output voltage, indicated by numeral 33.

Figure 7:
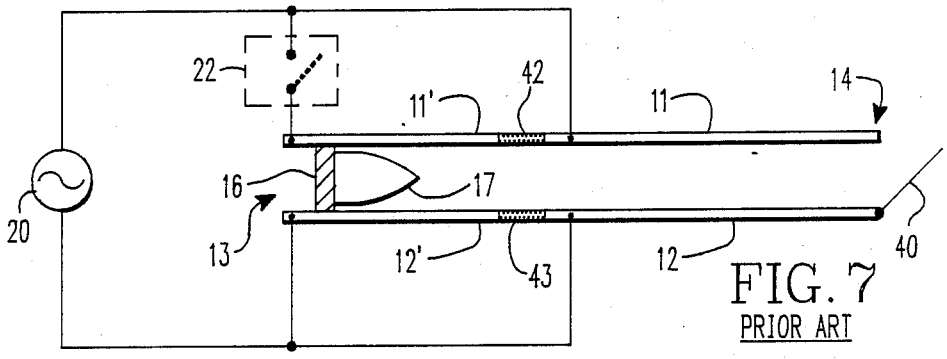
FIG. 7 PRIOR ART
FIG. 7 illustrates a typical pulsed AC generator electromagnetic launcher having a pre-acceleration arrangement.

The sudden application of a high current pulse to the stationary armature 16 in the arrangement of FIG. 2 may possibly cause damage to the armature or even a welding of the armature to the rails. Accordingly, it has been proposed to provide the armature with a preliminary acceleration prior to the application of the main pulse so that the armature is moving when .the high current is supplied to the rail system. A known arrangement for providing such preliminary acceleration is illustrated in FIG. 7. The rail system includes current limiting resistive inserts 42 and 43 dividing the rails into respective segments 11,11', and 12, 12'. The output of pulsed AC generator 20 is connected to the rails just after resistive inserts 42 and 43 and is connected to the breech end 13 by switch means 22.

Figure 8:
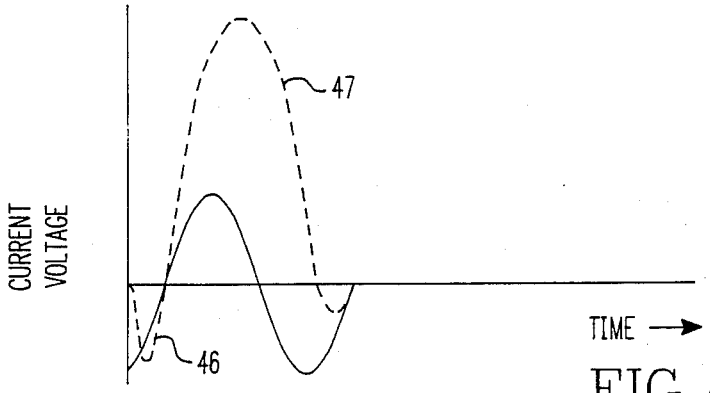
FIG. 8 shows waveforms illustrating the operation of FIG. 7.

The arrangement of FIG. 7 is operated such that switch means 22 closes earlier in the cycle, as illustrated by the waveforms of FIG. 8. The timing is such that a small injection current 46 is supplied to the armature 16 to provide the initial preliminary acceleration and once past the resistive inserts 42 and 43, the armature itself switches the main current on whereupon the positive pulse 47 is applied to the armature 16 as it passes from the preliminary acceleration section 11', 12', to the main section, 11, 12 of the rail system. The arrangement also allows the use of a smaller capacity switching means 22 since it now carries only the relatively small injection current.

As seen in FIG. 8, the main pulse 47 for driving the armature to a desired velocity is not fully offset and accordingly the magnitude of the DC pulse available for the acceleration is decreased resulting in a deterioration of the performance of the launcher system. With the present invention, no such performance deterioration takes place and a fully offset high magnitude DC pulse may be provided so as to attain the desire exit velocity. One embodiment of the present invention is illustrated in FIG. 9 to which reference is now made.

Figure 9:
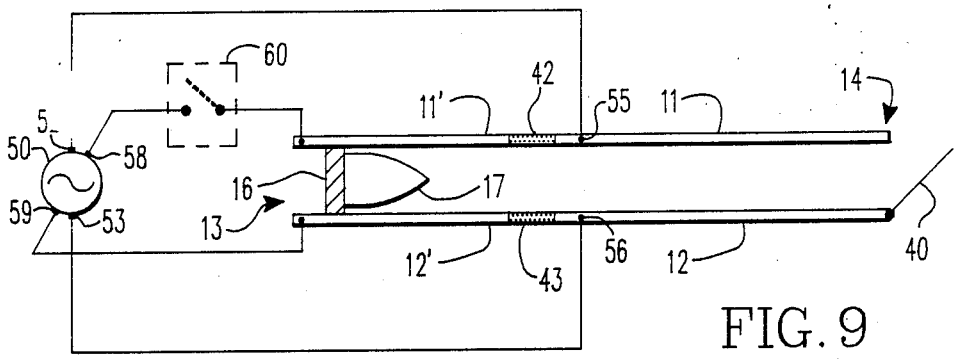
FIG. 9 illustrates one embodiment of the present invention.

The embodiment of FIG. 9 includes a pulsed AC generator 50 having first output terminals 52, 53 connected to high current connection 55, 56 intermediate the ends of the rails and adjacent the resistive inserts 42 and 43, as illustrated. Generator 50 additionally includes second output terminals 58, 59 connected to the breech end 13 of the rails by way of switching means 60.

Figure 10:
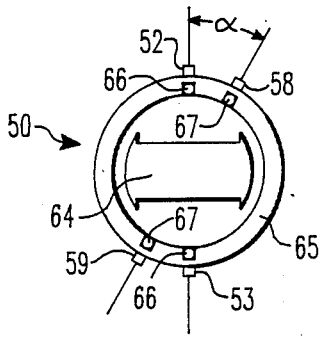
FIG. 10 illustrates the rotor and stator of an AC generator using the embodiment of FIG. 9.
Figure 11:
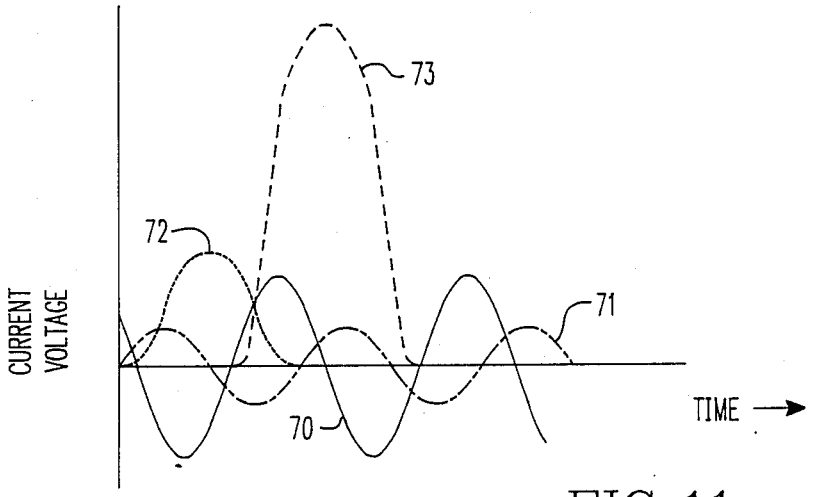
FIG. 11 shows waveforms to illustrate the operation of the embodiment of FIG. 9.

With additional reference to FIG. 10, there is illustrated a simplified representation of the pulsed AC generator 50 having a rotor 64 and stator 65. The stator includes a main stator winding 66 for providing a high current pulse at the output terminals 52, 53 for driving the armature in the main rail section 11, 12. The stator additionally includes an auxiliary stator winding 67 connected to output terminals 58, 59 for delivering a relatively low current pulse to the preliminary acceleration rail section 11', 12'. The auxiliary winding 67 is angularly displaced from the main stator winding 66 by an angle $\alpha$ so that with proper timing the preliminary acceleration or injection current pulse will accelerate the armature 16 such that it switches on the main current at exactly the right instant when the armature passes resistive inserts 42, 43, to thereby obtain a fully offset pulse without any reduction in magnitude. That is, with the arrangement of FIG. 9, switch means 60 still carries the small injection current, but the main current is not reduced. FIG. 11 illustrates certain waveforms associated with the operation of the embodiment of FIG. 9. Solid curve 70 represents the generator main voltage waveform and dot dashed curve 71 represents the auxiliary winding voltage waveform. Dotted curve 72 represents the injection current pulse relative to voltage waveform 71 and dotted curve 73 represents the main injection current pulse relative to voltage waveform 70.

Figure 12:
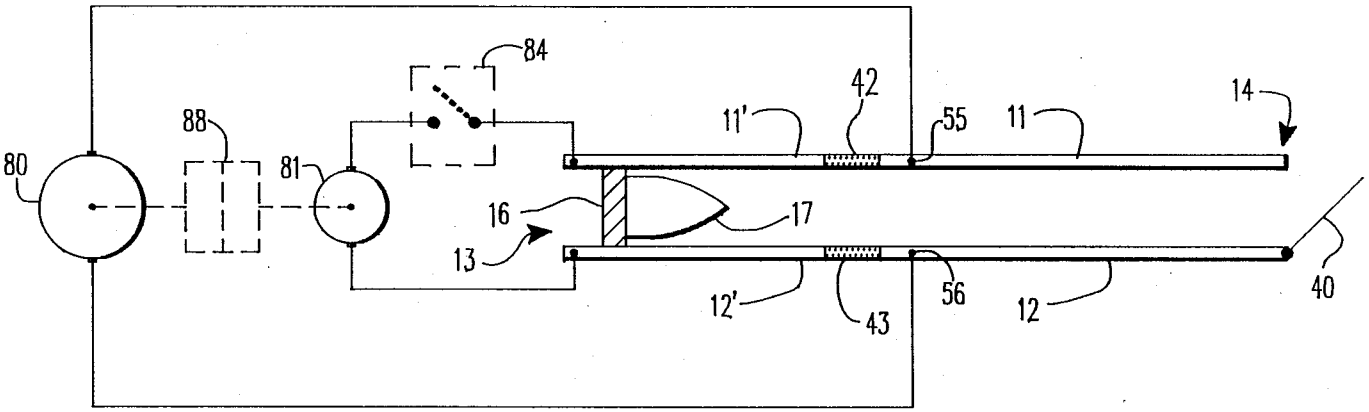
FIG. 12 illustrates another embodiment of the present invention.

In another embodiment of the invention illustrated in FIG. 12, pulsed AC generator means are provided and includes a first pulsed AC generator 80 as well as a second pulsed AC generator 81. Generator 80 is constructed and arranged to deliver a main high current pulse to high current connection 55, 56 whereas generator 81, connected to breech end 13 via switch means 84, is constructed and arranged to deliver the relatively lower current pulse for preliminarily accelerating the armature 16. Generators 80 and 81 are operated to be synchronized such that the pulses for pre-acceleration and main acceleration are provided as presented in FIG. 11. As an alternative, the generators 80 and 81 could be built on the same shaft or they could be connected together by an adjustable coupling illustrated in phantom as indicated by numeral 88

We claim:

1. Electromagnetic projectile launcher apparatus, comprising:

(A) a pair of generally parallel conductive launcher rails having a breech end and a muzzle end;

(B) said rails including a high current connection at a location intermediate said ends;

(C) said rails including a high resistance portion disposed between said high current connection and said breech end;

(D) an armature for conducting current between said rails for propelling a projectile along said rails, said armature being initially located near said breech end;

(E) pulsed AC generator means having first output terminals for providing a relatively high current pulse, and second output terminals for providing a relatively low current pulse;

(F) means connecting said first output terminals to said high current connection;

(G) means including switch means connecting said second output terminals to said breech end;

(H) said pulsed AC generator means and said switch means being constructed and arranged to deliver said lower current pulse just prior to said higher current pulse to initially accelerate said armature past said high resistance portion whereupon said high current pulse delivered to said current connection will accelerate said armature to its desired exit velocity.

2. Apparatus according to claim 1 wherein:

(A) said pulsed AC generator means is a single generator including a rotor and stator;

(B) said stator includes a primary stator winding and an auxiliary stator winding which is angularly spaced from said primary stator winding by a predetermined number of degrees;

(C) said first output terminals being connected to said primary stator winding; and (D) said second output terminals being connected to said auxiliary stator winding.

3. Apparatus according to claim 1 wherein:

(A) said pulsed AC generator means includes first and second pulsed AC generators each including a rotor and stator;

(B) each said stator including a respective stator winding;

(C) each said rotor being connected to a respective shaft; and (D) coupling means coupling said shafts of said generators together.

4. Apparatus according to claim 3 wherein:

(A) said coupling means is adjustable to vary the relative angular orientation of said rotors of said first and second pulsed AC generators.

5. Apparatus according to claim 1 wherein:

(A) said pulsed AC generator means includes first and second distinct pulsed AC generators synchronized to deliver their respective high and low current pulses.

* * * * *